United States Patent [19]

Schibbye et al.

[11] 4,042,310

[45] Aug. 16, 1977

[54] SCREW COMPRESSOR CONTROL MEANS

[75] Inventors: Hjalmar Schibbye, Saltsjo-Boo; Arnold Englund, Vallingby, both of Sweden

[73] Assignee: Svenska Rotor Maskiner Aktiebolag, Nacka, Sweden

[21] Appl. No.: 589,021

[22] Filed: June 23, 1975

[30] Foreign Application Priority Data

June 21, 1974 United Kingdom ..... 27616/74

[51] Int. Cl.[2] ..... F04B 49/00; F01C 1/16

[52] U.S. Cl. ..... 417/310; 418/201

[58] Field of Search ..... 417/309, 310; 418/159, 418/197, 201

[56] References Cited

U.S. PATENT DOCUMENTS

| | | | |
|---|---|---|---|
| 2,021,613 | 11/1935 | Sheppard | 417/310 |
| 3,088,658 | 5/1963 | Wagenius | 418/201 |
| 3,088,659 | 5/1963 | Nilsson | 418/201 |
| 3,656,876 | 4/1972 | Kocher | 418/201 |
| 3,738,780 | 6/1973 | Edstrom | 418/159 |
| 3,874,828 | 4/1975 | Herschler et al. | 418/201 |

FOREIGN PATENT DOCUMENTS

| | | | |
|---|---|---|---|
| 1,804,884 | 9/1970 | Germany | 418/201 |

*Primary Examiner*—Carlton R. Croyle
*Assistant Examiner*—Gregory L. LaPointe
*Attorney, Agent, or Firm*—Flynn & Frishauf

[57] ABSTRACT

Volume control valve for a screw compressor located in a cylindrical bore parallel to and spaced from the working space. The bore and the working space communicate through a number of axially distributed channels which are selectively closed by an adjustable valve member disposed in the bore.

10 Claims, 6 Drawing Figures

2
66
68
72
60
14
58
3
3
16
56
4
4
10
32
54
62
46
24
42
22
22
12
2

SCREW COMPRESSOR CONTROL MEANS

The present invention relates to means for variation of the volumetric capacity of a compressor of the screw rotor type.

A screw rotor compressor to which the present invention pertains comprises a casing having a working space disposed therein in the shape of two intersecting bores with parallel axes, a high pressure end wall at one end thereof, and a low pressure end wall at the other end thereof. A pair of intermeshing male and female rotors are disposed in the working space in sealing engagement with the casing and the end walls thereof. The rotors have helical lands and intervening grooves with a wrap angle of less than 360°. The male rotor has the major portion of its lands and grooves outside the pitch circle of the rotor and is provided with substantially convex flanks of the lands, whereas the female rotor has the major portion of its lands and grooves inside the pitch circle of the rotor and is provided with substantially concave flanks of the lands. A low pressure port provided in the walls of the working space adjacent to the low pressure end wall is in flow communication with an inlet channel in the casing. A high pressure port provided in the walls of the working space adjacent to the high pressure end wall is in flow communication with an outlet channel in the casing. The low pressure and high pressure ports are located substantially on opposite sides of a plane through the axes of the bores of the working space.

It is essential under many operating conditions to be able to adjust the volumetric capacity of a compressor running at a constant speed, especially when the compressor is driven by an electric motor. One method for such an adjustment is shown in US Pat. No. 3 314 597 where an axially adjustable valve is disposed in the barrel wall of the working space and controls at one end thereof a bleed port from the working space to the inlet channel, and at the other end thereof the shape and size of the high pressure port. However, such a valve is complicated and expensive to manufacture as it must sealingly cooperate with the rotors. Furthermore it is exposed to the high pressure in the outlet channel as well as the low pressure in the inlet channel, resulting in considerable forces thereon and in risks for leakage along the valve as well as for tilting if the guidance surfaces thereof are not extremely well shaped.

OBJECT OF THE INVENTION

The object of the present invention is to achieve a simpler and cheaper bleed valve especially for small refrigeration compressors, having a comparably low pressure ratio of about 3 to 1, which valve further is exposed to the low pressure in the inlet channel only so that the risks for leakage and tilting related to the earlier design of the control valve can be completely eliminated.

BRIEF DESCRIPTION OF THE DRAWINGS

The invention will be described more in detail in the following part of this specification, in connection with some embodiments of compressors shown in the accompanying drawings, in which.

DETAILED DESCRIPTION OF ILLUSTRATED EMBODIMENT

Figure 1:
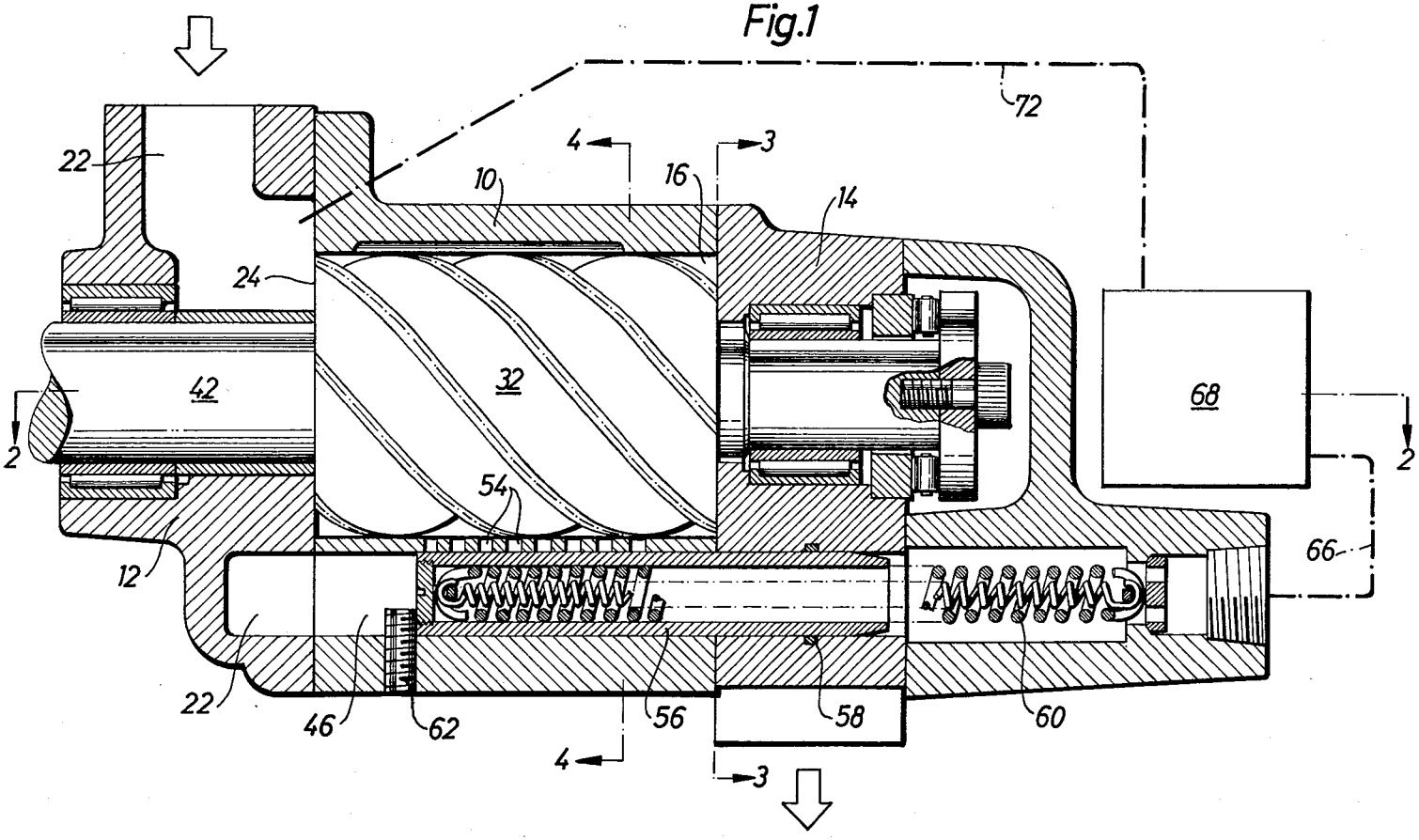
FIG. 1 shows a vertical section of a compressor taken along line 1—1 in FIG. 2.
Figure 2:
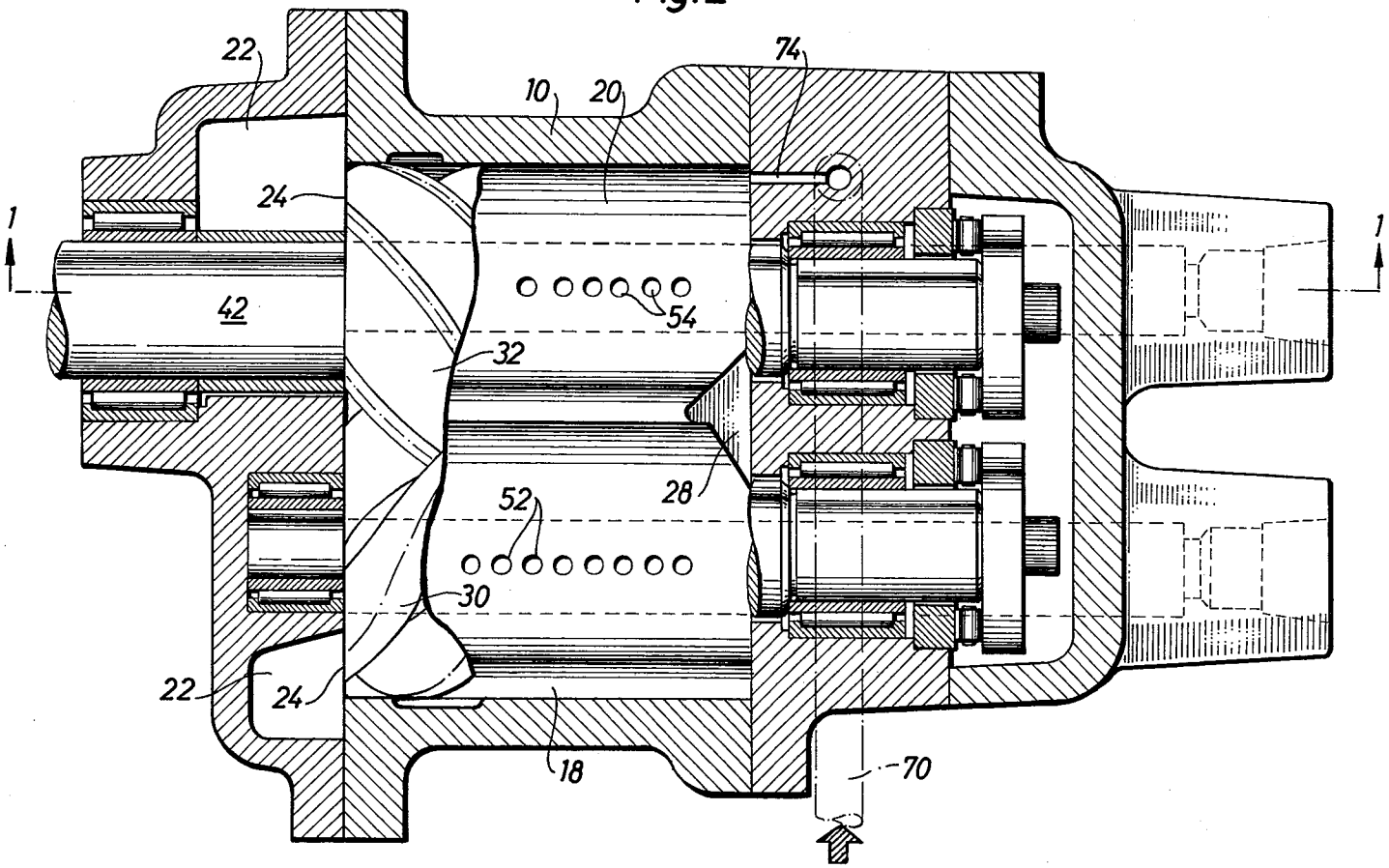
FIG. 2 shows a horizontal section taken along line 2—2 in FIG. 1.
Figure 3:
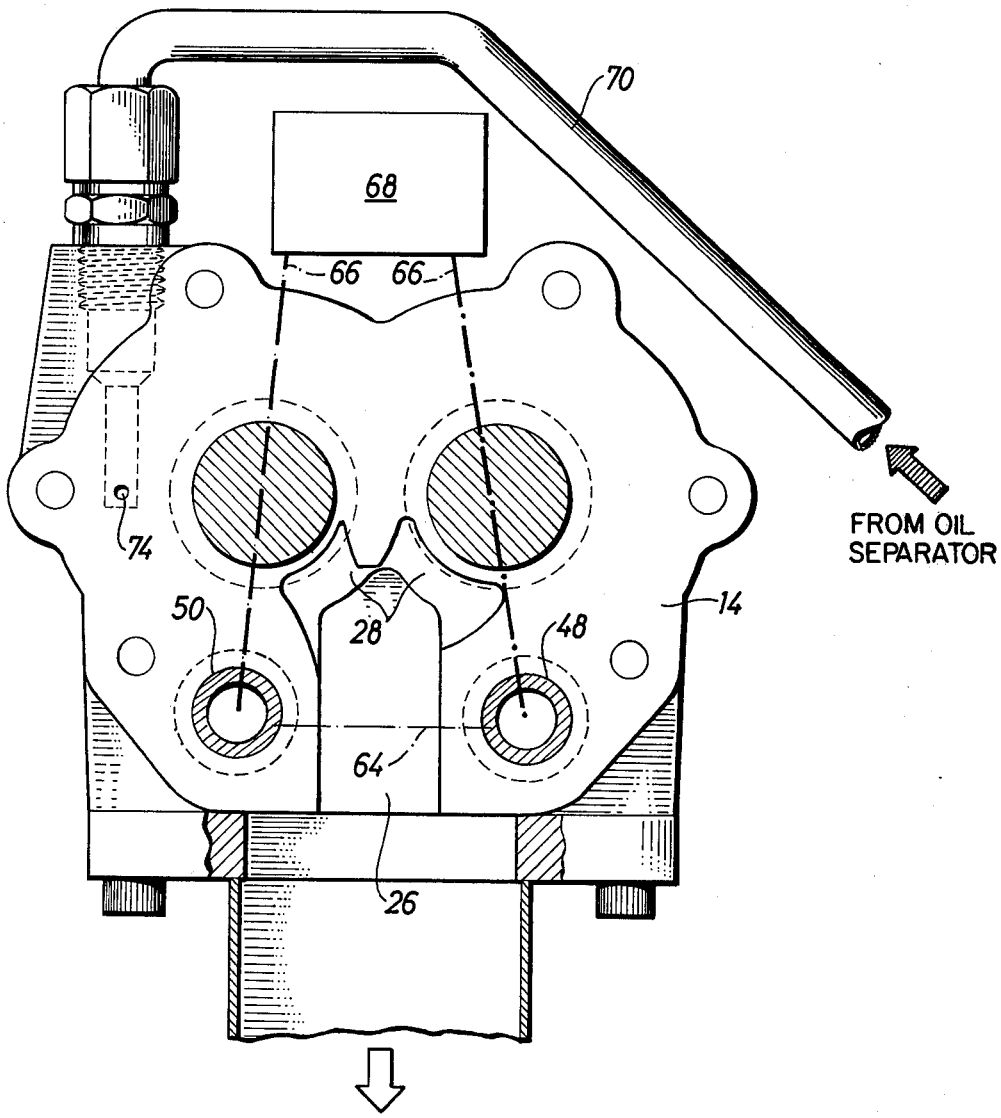
FIG. 3 shows a cross section taken along line 3—3 in FIG. 1.
Figure 4:
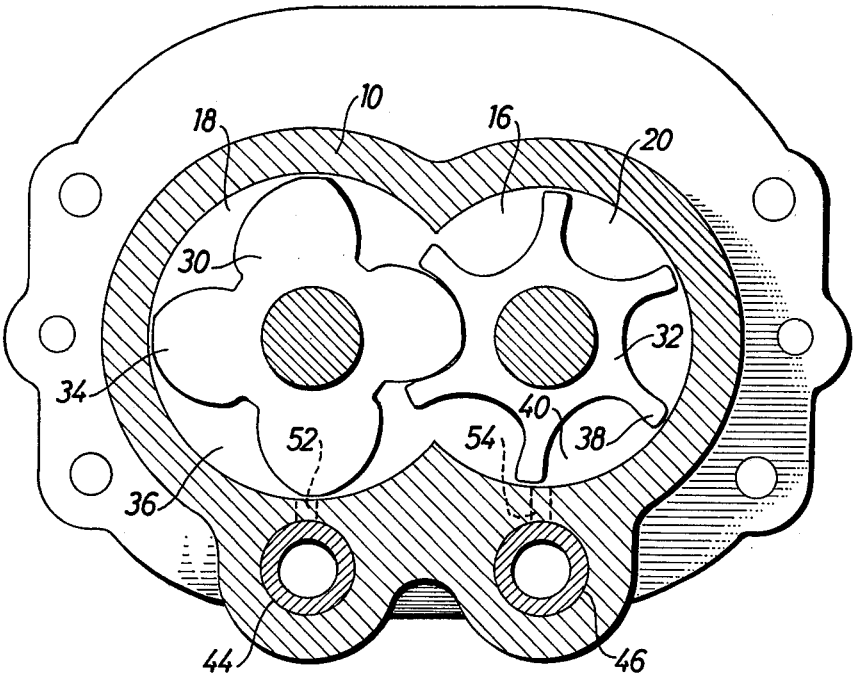
FIG. 4 shows a cross section taken along line 4—4 in FIG. 1.

The screw compressor shown in FIGS. 1-4 comprises a casing 10 provided with a low pressure end plate member 12 and with a high pressure end plate member 14, enclosing a working space 16, substantially in the shape of two intersecting cylindrical bores 18, 20, an inlet channel 22 communicating with the working space 16 through a low pressure port 24, and an outlet channel 26 (FIG. 3) communicating with the working space 16 through a high pressure port 28. Two intermeshing rotors, on male rotor 30 and one female rotor 32, are disposed in the working space 16 and are rotatably mounted in the end plate members 12, 14 with their axes coaxial with the axes of the bores 18, 20 by means of antifriction bearings. As seen in FIG. 4, the male rotor 30 is provided with four helical lands 34 with intervening grooves 36 which have a wrap angle of about 300°. The lands 34 have flanks the major portions of which are convex and located outside the pitch circle of the rotor 30. The female rotor 32 is provided with six helical lands 38 and intervening grooves 40 which have a wrap angle of about 200°. The grooves 40 have flanks the major portions of which are concave and located inside the pitch circle of the rotor 32. The profiles of the rotors 30, 32 are generally of a shape disclosed in U.S. Pat. No. 3,423,017. The female rotor 32 is further provided with a stub shaft 42 extending outside the low pressure end plate member 12 and adapted for connection to a driving motor, not shown.

Most of the low pressure port 24 is disposed on one side of the plane of the axes of the bores 18, 20 and the high pressure port 28 is completely disposed on the other side of said plane.

The casing 10 is further provided with two valve bores 44, 46 spaced from the working space 16 and parallel with the axes of the bores 18, 20 of the working spaces. Each of the valve bores 44, 46 is at one end thereof in open flow communication with the inlet channel 22, and extends at the other end thereof into a cavity 48, 50 (FIG. 3) provided in the high pressure end plate member 14. The valve bores 44, 46 are so spaced that the cavities 48, 50 are disposed on opposite sides of the outlet channel 26 without interference or communication therewith. A number of axially spaced overflow channels 52, 54 (FIGS. 1 and 2) are provided in the barrel wall of each working space bore 18, 20 and extend to the adjacent valve bore 44, 46 for flow communication between the working space 16 and the inlet channel 22.

An axially adjustable, cylindrical valve member 56 is disposed in each valve bore 44, 46 and sealingly connected thereto by means of a sealing ring 58, preferably of 0-ring type of rubber or similar material. This sealing ring 58 is disposed on the high pressure side of the overflow channels 52, 54. The valve member 56 is shaped as a closed tube acting as the piston of a one way pressure fluid operated piston and cylinder servo motor, where the valve bore 44, 46 and the annexed cavity 48, 50 acts as the cylinder. The valve member 56 is further connected with a spring 60 biasing the valve member in direction towards the high pressure end of the compressor. A stop 62 is inserted in the wall of the valve bores 44, 46 to define the end position of the valve member 56. The cavities 48, 50 are interconnected by a channel 64 and by another channel 66 in communication with a regulator valve 68 alternatively for admission of pressurized oil through a pipe 70 from an oil separator (FIG. 3) on the high pressure side of the compressor to the servo motor cylinder 48, 50, and for carrying off oil from the servo motor cylinder 48, 50 to the compressor low pressure side through a pipe 72 to the inlet channel 22. The regulator valve 68 operates automatically in dependence upon the actual pressure in the inlet channel 22 to which it is connected through said pipe 72. Oil from the oil separator is further admitted to the working space 16 through a channel 74 for lubricating, sealing and cooling purposes.

Under normal maximum capacity drive conditions the regulator valve 68 admits pressure oil to the servo motor cylinders 44, 48 and 56, 50 so that the valve members 56 are kept against the stop 62, whereby the communication from the working space 16 to the inlet channel 22 is positively blocked. When the pressure in the inlet channel 22 decreases under a certain design pressure the regulator valve 68 decreases the pressure in the servo motor cylinders and allows some of the oil enclosed therein to be drained to the inlet channel 22 as the valve members 56 are moved to a position related to the pressure in the inlet channel 22 by means of the spring 60. As the valve members 56 move towards the high pressure end of the compressor one or more of the over-flow channels 52, 54 are opened up for fluid flow from the working space 16 back to the inlet channel 22, whereby the volumetric capacity of the compressor is reduced.

Figure 5:
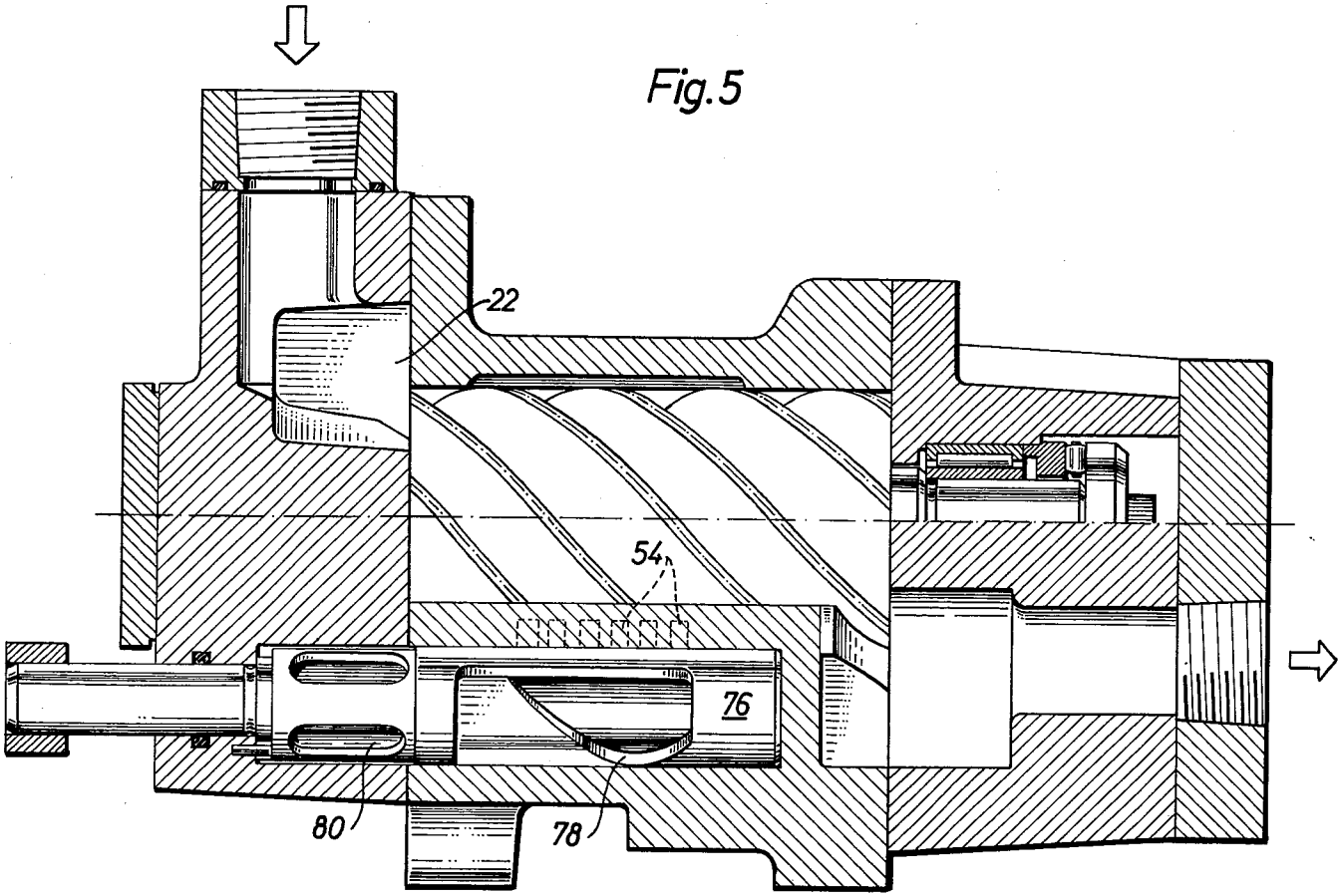
FIG. 5 shows a vertical section of another compressor.

FIG. 5 shows an alternative design of the valve member. In this case the valve member 76 is axially fixed and angularly adjustable by a servo motor not shown. The barrel wall of the valve member is partly cut away to provide a control edge 78 following a screw line so that the number of overflow channels 54 covered by the valve member 76 varies with the angular position thereof. The valve member is further provided with a number of openings 80 in its barrel wall for communication with the inlet channel 22.

Figure 6:
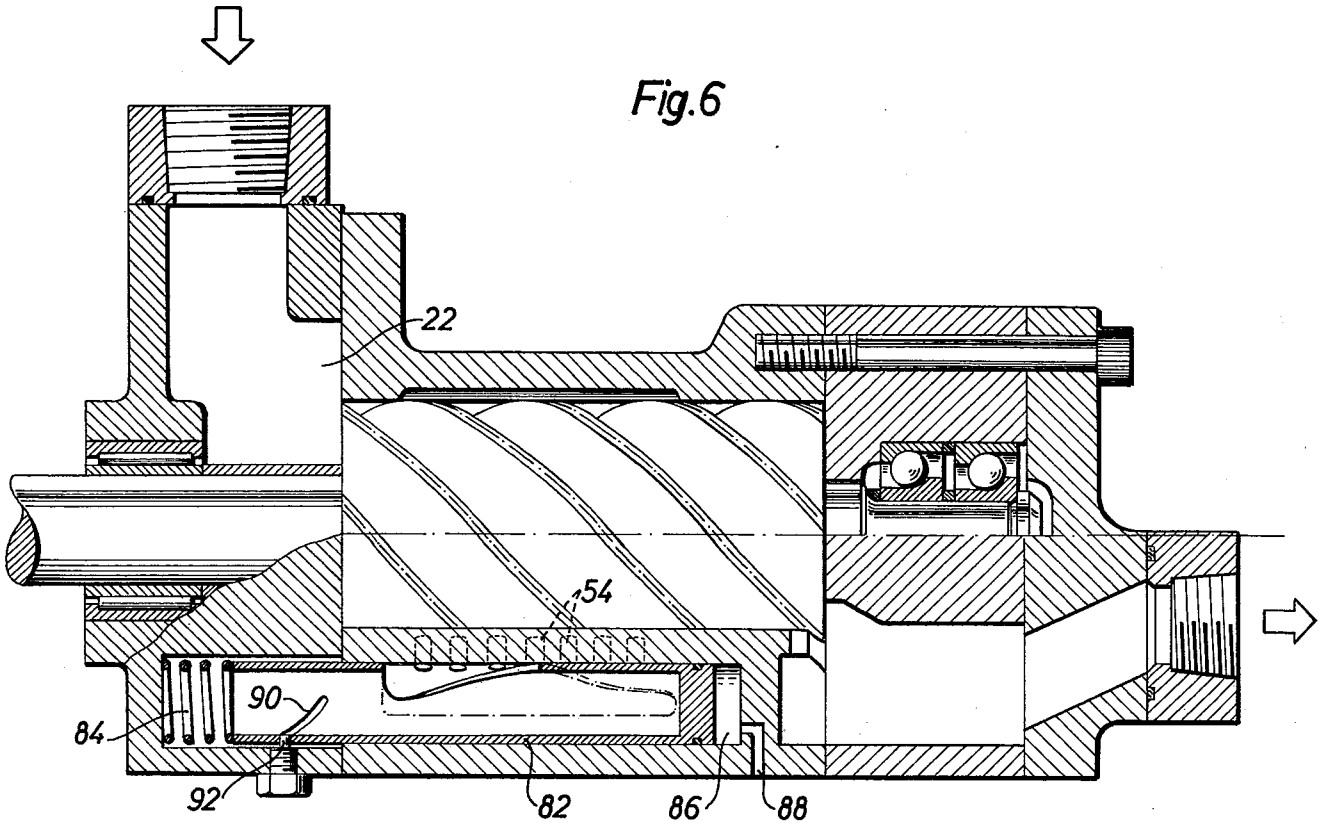
FIG. 6 shows a vertical section of a third compressor.

FIG. 6 shows a further embodiment of the valve member being a combination of the embodiments shown in FIGS. 1–4 and in FIG. 5. The valve member 82 is axially moved by a spring 84 and a hydraulically operated piston and cylinder servo motor, comprising the valve member 82 and the bore 86 which is provided with an opening 88 for the operating fluid. The valve member 82 is further in its barrel surface provided with a groove 90 following a screw line and cooperating with a stud 92 fixed in the wall of the bore 86 so that an axial movement of the valve member also results in an angular adjustment thereof. The valve member 82 must further be provided with a screw line control edge similar to the control edge 78 shown in FIG. 5. The function of the valve member 82 is similar to that of the valve member 76 shown in FIG. 5.

The embodiments of the valve member 76, 82 shown in FIGS. 5 and 6, respectively, have the advantage that there is no or only a small axial movement of the valve member so that it, without interference with the high pressure channel, can be located close to the line of intersection between the bores of the working space, whereby one single valve member may operate flow channels disposed in the barrel walls of both the bores of the working space.

We claim:

1. In a screw compressor comprising a casing with a working space disposed therein in the shape of two intersecting cylindrical bores with parallel axes, a high pressure end wall at one end thereof, a low pressure end wall at the other end thereof, intermeshing male and female rotors disposed in said working space in sealing engagement with said casing and the end walls thereof and having helical lands and intervening grooves with a wrap angle of less than 360°, said male rotor having the major portion of its lands and grooves outside the pitch circle thereof and with its flanks substantially convex, and said female rotor having the major portion of its lands and grooves inside the pitch circle thereof and with its flanks substantially concave, a low pressure port adjacent said low pressure end wall, a high pressure port at the end of said working space opposite from said low pressure port and with said ports being located substantially on opposite sides of a plane through the axes of said bores, an inlet channel in said casing in flow communication with said low pressure port and an outlet channel in said casing in flow communication with said high pressure port, means for varying the volumetric capacity of the screw compressor, comprising:

at least one valve bore parallel to the axes of the rotors and disposed on the high pressure side of said plane through the axes of the rotor bores;

a plurality of axially spaced overflow channels in said casing and in communication with the working space;

an axially adjustable valve body disposed in said at least one valve bore and sealingly cooperating with the barrel walls of the at least one valve bore to divide said valve bore into two valve chambers;

one of said valve chambers of said at least one valve bore being completely out of communication with the outlet channel of the compressor and in flow communication with the working space through said axially spaced overflow channels and being further in communication with a low pressure channel, the other of said valve chambers being selectively in communication with a pressure liquid source; and means for axially adjusting the position of said valve body so as to selectively block said overflow channels for variation of the communication between the working space and the at least one valve bore through said overflor channels.

2. Apparatus as defined in claim 1, further comprising an oil separator serving as said pressure liquid source which is coupled to said other of said valve chambers.

3. Apparatus as defined in claim 1, in which said valve body is provided with a control edge for cooperation with said overflow channels, said control edge being substantially perpendicular to the axis of said at least one valve bore.

4. Apparatus as defined in claim 3, comprising two valve bores spaced apart in a plane parallel to said plane through the axes of the rotor bores to such an extent that said valve bores pass the outlet channel on opposite sides thereof.

5. Apparatus as defined in claim 4, in which one of the overflow channels communicating with the female rotor bore which is disposed adjacent to the low pressure end wall of the working space is located a larger distance from said end wall than that of the corresponding overflow channel of the male rotor bore.

6. Apparatus as defined in claim 4 wherein each of said valve bores are in communication with a respective rotor bore.

7. Apparatus as defined in claim 1, comprising a stud and a groove following a screw line for interconnecting said valve body and the wall enclosing said at least one valve bore, said stud and groove providing a combined axial and turning adjustment of said valve body.

8. Apparatus as defined in claim 7, in which said at least one valve bore is disposed adjacent to the line of intersection between the rotor bores and in communication with both of the rotor bores through separate overflow channels.

9. Apparatus as defined in claim 1, in which said valve body is shaped as a tube provided with a transverse wall.

10. Apparatus as defined in claim 9, in which said means for adjusting the position of said valve body comprises:

the portion of said at least one valve bore facing the high pressure end wall and a portion of said valve body, said portions acting as a cylinder and piston, respectively, of a pressure fluid servomotor for adjustment towards positions for higher capacity; and a spring acting upon said valve body for adjustment towards positions for lower capacity.

* * * * *